US005499922A

United States Patent [19]

Umeda et al.

[11] Patent Number: 5,499,922

[45] Date of Patent: Mar. 19, 1996

[54] BACKING CHORUS REPRODUCING DEVICE IN A KARAOKE DEVICE

[75] Inventors: Toshihiko Umeda, Kanagawa; Itsuma Tsugami, Saitama, both of Japan

[73] Assignees: Ricoh Co., Ltd., Tokyo; Ricos Co., Ltd., Osaka, both of Japan

[21] Appl. No.: 230,765

[22] Filed: Apr. 21, 1994

[30] Foreign Application Priority Data

Jul. 27, 1993 [JP] Japan ..... 5-205780

[51] Int. Cl.[6] ..... G10H 1/36

[52] U.S. Cl. ..... 434/307 A; 434/318; 84/610

[58] Field of Search ..... 434/307 R, 307 A, 434/308, 309, 318, 365; 84/454, 477 R, 601, 609, 615, 645, 625; 369/32, 48, 50; 360/33.1, 77.01; 358/310, 335, 342; 348/478, 484, 571, 595, 738

[56] References Cited

U.S. PATENT DOCUMENTS

| | | | |
|---|---|---|---|
| 5,046,004 | 9/1991 | Tsumura et al. | 84/601 X |
| 5,194,682 | 3/1993 | Okamura et al. | 434/307 A |
| 5,235,124 | 8/1993 | Okanura et al. | 434/307 A |
| 5,243,123 | 9/1993 | Chaya | 84/625 X |
| 5,247,126 | 9/1993 | Okamura et al. | 358/335 X |
| 5,294,746 | 3/1994 | Tsumura et al. | 434/307 A |

*Primary Examiner*—Joe Cheng
*Attorney, Agent, or Firm*—Thompson, Hine & Flory

[57] ABSTRACT

A backing chorus reproducing device is disclosed wherein human backing chorus is PCM coded and then combined with MIDI Standard based instrumental sound to produce karaoke music. In reproduction, the instrumental sound and the chorus sound are played back with no out-of-synchronization therebetween. The backing chorus reproducing device comprises a communications controller, an input/output device for inputting an instruction for a music number and a change of scale, a memory for storing karaoke information received, a main controller for analyzing the karaoke information read from the memory to decompose it into header information, song's words information, and musical information, while outputting in synchronism the electronic musical sound data and the backing chorus data of the musical information according to the processing type of the control data included in the header information. The backing chorus reproducing device further comprises an electronic musical sound reproducing device for reproducing the electronic musical sound data provided by the main controller, a voice controller for reading the backing chorus data of a take which corresponds to the processing type extracted by the main controller, a backing chorus reproducing including the voice controller for reproducing the backing chorus data, and a words/video display controller for presenting the words information according to the instruction given by the main controller.

4 Claims, 6 Drawing Sheets

FIG. 5a CONTROL DATA

| ID | PROCESSING TYPE |
|---|---|
| 1 | INITIATION OF WORDS COLOR TURNING |
| 2 | PAGE TURNING |
| 3 | WORDS SCROLLING |
| 4 | DYNAMIC IMAGE SWITCHING |
| 5 | INITIATION OF BACKING CHORUS |
| 6 | TITLE PRESENTATION |

FIG. 5b PROCESSING TYPE

BACKING CHORUS REPRODUCING DEVICE IN A KARAOKE DEVICE

BACKGROUND OF THE INVENTION

1. Field of the Invention

The present invention is directed to a karaoke device that plays back an instrumental sound based on the MIDI Standard and presents image and words in synchronism with the sound on a screen, and particularly to a technique that allows the instrumental sound to be mixed with backing chorus.

2. Description of the Prior Art

Recently in widespread use is a karaoke system in which each terminal receives karaoke information via communications line from a host computer that holds a vast amount of digitized and coded karaoke information and then reproduces the received karaoke music. Means of minimizing the amount of data for karaoke information in communications is a known technique in which instrumental sound is constructed of electronic musical sound source based on the MIDI Standard. Instrumental sound based on performance of musical instruments is easy to handle to form musical data that are based the MIDI Standard, and thus appealing in the activity of the creation of karaoke music. In one of the prior art techniques, the reproduction of a backing music and the display of video images are synchronized, and further words of a karaoke song are presented on screen along with progress of the song being performed.

In such a system, however, each terminal can play back the instrumental sound only, and "human" backing chorus cannot be played back along with the instrumental sound because the backing chorus is not constructed according to the MIDI Standard. An idea is contemplated in which an electronic musical instrument that has a capability of synthesizing human voice is used to produce a backing chorus that is then played back along with the instrumental sound. Although an electronic musical instrument can synthesize human voice, the waveforms of human voice are extremely complicated. In practice, a human backing chorus cannot be reproduced by any electronic musical instrument.

SUMMARY OF THE INVENTION

The present invention has been developed in view of this issue. It is an object of the present invention to provide a karaoke machine that produces a karaoke music by combining a PCM-coded human backing chorus and a MIDI-based instrumental sound and reproduces both the instrumental sound and the backing chorus in synchronism.

To achieve the above object, the present invention comprises communications control means for receiving via a communications line a plurality of karaoke information that are stored in a host computer, input/output means for inputting an instruction for a music number and an instruction for a change of scale, memory means for storing karaoke information received, main controller means for analyzing the karaoke information read from the memory means to decompose it into header information, song's words information, and musical information while outputting in synchronism the electronic musical sound data and the backing chorus data of the musical information according to the processing type specified by the control data included in the header information, electronic musical sound reproducing means for reproducing the electronic musical sound data provided by the main controller means, voice controller means for reading a take of the backing chorus data that corresponds to the processing type extracted by the main controller means, backing chorus reproducing means including the voice controller for reproducing the backing chorus data, and words/video display controller means for presenting the words information according to the instruction given by the main controller means.

The backing chorus data is segmented into take data by block and, from among take data, repetitive take data blocks are transferred to the voice controller means by the main controller means. Upon receiving the scale indicator selected by the input/output means, the main controller means issues the scale indicator along with a scale change instruction to the electronic musical sound reproducing means and the voice controller so that scale changing is achieved with the electronic musical sound data synchronized with the backing chorus data in performance.

According to the present invention organized as above, the main controller means decomposes the karaoke music into the musical information, the words information, and the header information. Under the control of a built-in timer, the main controller means sends, in synchronism and in parallel, the words information to the words/video display controller, the MIDI-based electronic musical sound data out of the musical information to the electronic musical sound reproducing means, and the PCM-coded backing chorus data out of the musical information to the backing chorus reproducing means via the voice controller. To reproduce the backing chorus, the main controller means initiates the counting of time intervals of the control data contained in the header information against a threshold set, and at the time-out timing performs the process according to the processing type of the control data. For example, when the processing type is the initiation of the reproduction of backing chorus, the backing chorus is reproduced in synchronism with the electronic musical sound. Some portion of the backing chorus is often repeated in the same music. In the present invention, therefore, the backing chorus is segmented in a plurality of blocks, and each block is designated as take data that is used as a unit in reproducing process. The take data are repetitively used, and thus memory requirement for the backing chorus data is minimized.

The scales of the electronic musical sound and the backing chorus are allowed to change as appropriate according to the scale change instruction from the input/output means, and thus keys are adjusted to the voice range of a singer who is enjoying a karaoke.

DETAILED DESCRIPTION OF THE PREFERRED EMBODIMENT

Figure 1:
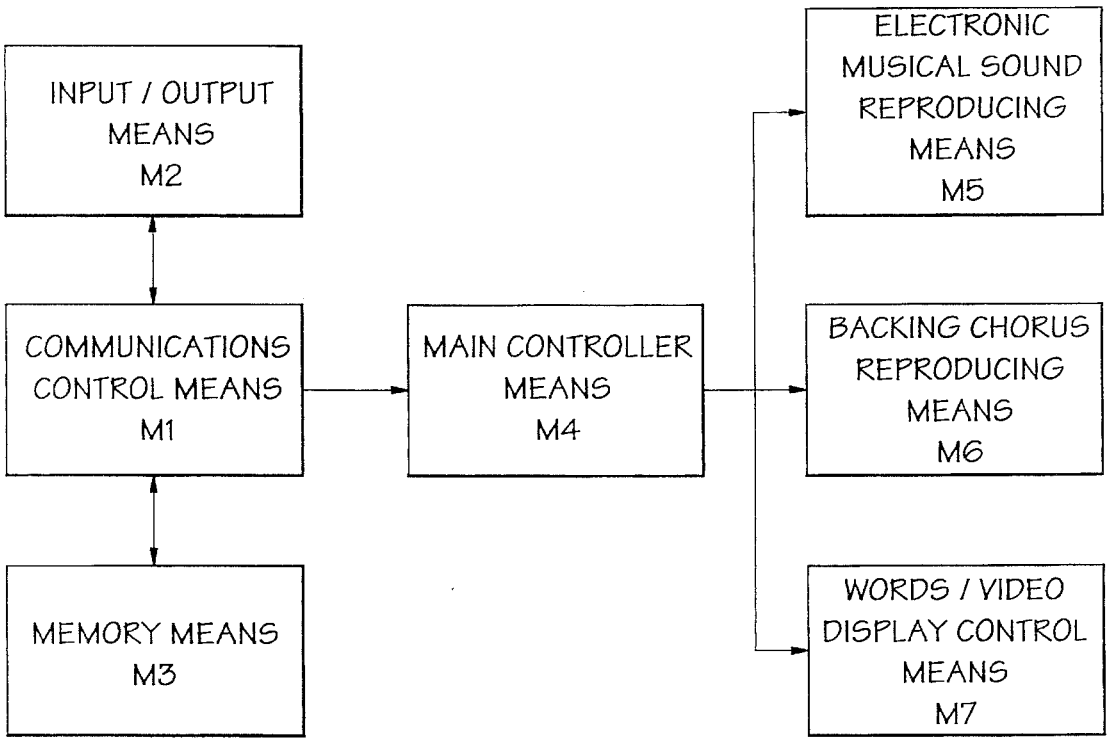
FIG. 1 is a block diagram showing generally the construction of the present invention.

Referring now to the drawings, the preferred embodiment of the present invention is discussed. As seen from FIG. 1, the karaoke machine according to the present invention essentially comprises communications control means M1 for communicating with a host computer, input/output means M2 for inputting a music number when the request of a library presentation or a music service is made to the host computer, memory means M3 onto which the karaoke information received is downloaded, main controller means M4 for processing the karaoke information and controlling the karaoke machine in a series of control actions, electronic musical sound reproducing means M5 for processing the MIDI-based electronic musical sound data, backing chorus reproducing means M6 for processing PCM-coded backing chorus data, and a words/video display control means M7.

Figure 2:
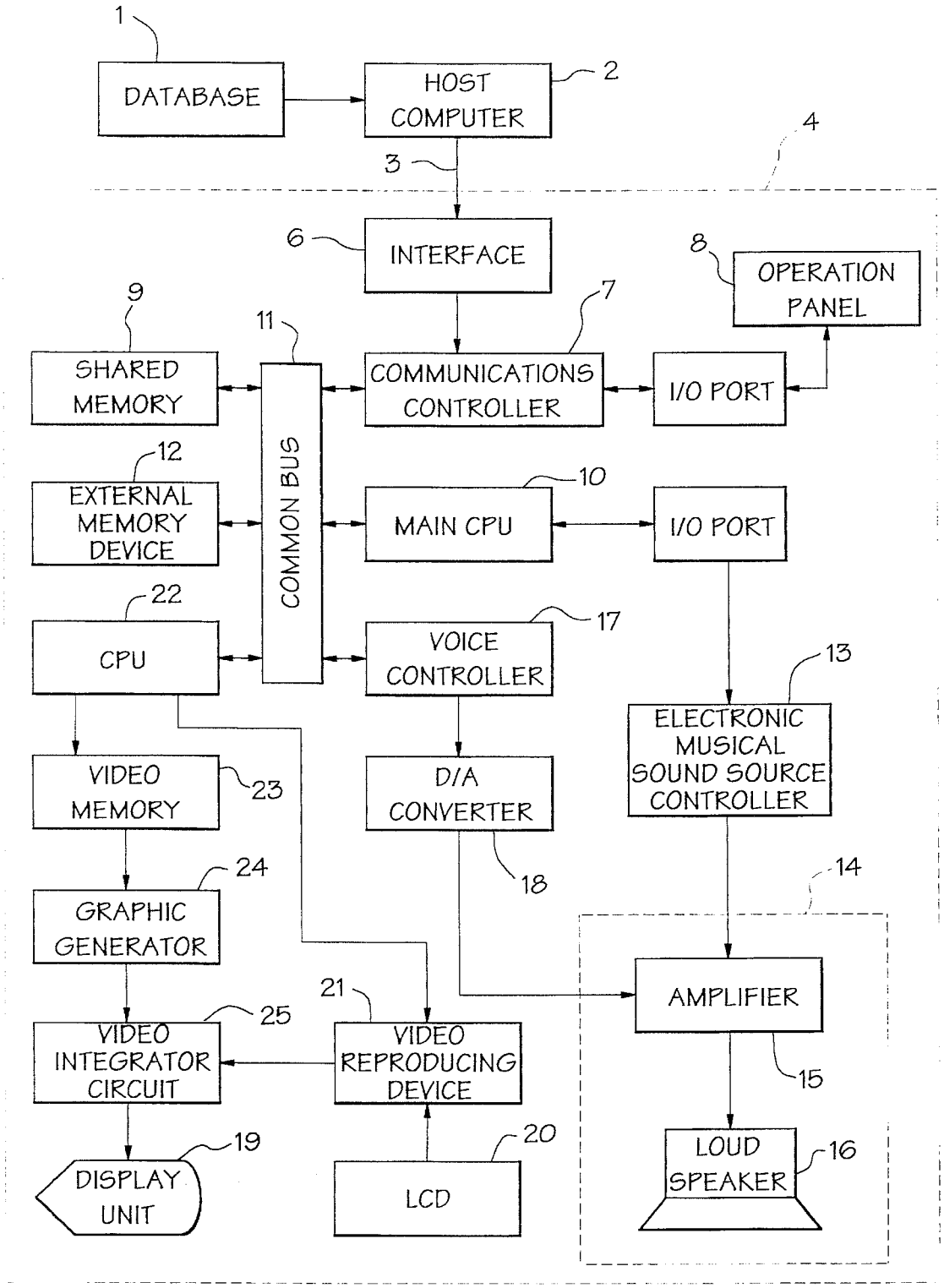
FIG. 2 is a block diagram showing the construction of the embodiment of the present invention..

Referring now to FIG. 2, each of the above means is discussed more in detail. The host computer 2 holds, as a database 1, a number of pieces of karaoke information digitized and coded, and communicates the karaoke information with a karaoke machine 4 via a communications line 3. In this embodiment, the ISDN is used as the communications line 3 to perform digital communication. Alternatively, analog communication is also possible using an analogy telephone network. An interface 6 is provided herein so that the karaoke machine may be switchably interfaced with an analog communication network.

Designated at 7 in the karaoke machine 4 is a communications controller having as its core a CPU. The communications controller 7 constitutes the communications control means M1 in FIG. 1. An operation panel 8 as the input/output means M2 is connected to the communications controller 7 via an I/O port. The communications controller 7 exchanges data of karaoke information with the host computer 2. The operation panel 8 is constructed of an LCD and a keyboard. The LCD presents a library of karaoke information, and the keyboard is used to input a music number according to the listing in the library. When a number corresponding to a desired music is input through the operation panel 8, the music number data are transferred to the host computer 2 via the communications controller 7. The host computer in turn sends the karaoke information corresponding to the music number, and the karaoke information is stored in a shared memory 9 via a common bus 11. The shared memory 9 constitutes the memory means M3 in FIG. 1. By making a request to the host computer, the song a singer desires to sing is received and then registered. It is acceptable that the shared memory 9 as the memory means M3 has a memory capacity of karaoke information of a single piece of music. In this embodiment, the memory capacity of the shared memory 9 is a few MB capable of accommodating a total of 10 pieces of music: one piece being performed, 8 pieces reserved, plus one piece for interruption. The shared memory 9 thus accommodates the karaoke information for a plurality of pieces of music, thereby allowing rapid processing.

Designated at 10 is the main CPU corresponding to the main controller means M4. The CPU 10 processes the karaoke information the communications controller 7 feeds via the common bus 11. The data structure of the karaoke information will be detailed later. Now, the operation of the main CPU 10 is discussed. The main CPU 10 decomposes the data structure of the karaoke information into the musical information, the words information, and the header information, according to unit of the karaoke information, and processes each piece of information in parallel and in synchronism according to a built-in timer. When the operation panel 8 issues a scale change instruction via the communications controller 7 in the middle of performance of a song, the CPU 10 shifts to the scale as instructed. In this embodiment, the scale default indicator is 0, and can be shifted to +1, −1, at steps of chromatic-scale unit, with a total of five steps available. An external memory device 12 such as a hard disk drive stores a great deal of karaoke information and a variety of font data capable of offering character patterns for the words of the song to be presented. For example, the karaoke information already registered in the external memory device 12 may be loaded onto the shared memory 9 via the common bus 11, the karaoke information stored in the shared memory 9 may be registered back into or newly registered into the external memory device 12.

An electronic musical sound source controller 13 that constitutes the electrical musical sound controller means M5 processes the MIDI-based electrical musical sound data out of the musical information into which the main CPU 10 decomposes the karaoke information. The electronic musical sound source controller 13 analog-to-digital converts the electronic musical sound data into an analog signal, which is then applied to a loudspeaker block 14 made up of an amplifier 15 and a loudspeaker 16 for amplification and reproduction.

A voice controller 17 having a CPU, as the backing chorus reproducing means M6, decodes the PCM signal that is defined as a human voice as a result of analysis by the main CPU 10, performs sampling rate conversions to the decoded signal and feeds it to a tone and digital-to-analog converter 18. The backing chorus signal that is digital-to-analog converted by the tone and digital-to-analog converter 18 is mixed with the electronic musical sound signal at the amplifier, and then the mixed signal is given off via the loudspeaker 16.

The words/video display control means M7 is constructed of a CPU 22, a video memory 23, graphic generator 24, and a video integrator circuit 25. To present words of a song on screen, the CPU 22 receives via the common bus 11 the words information obtained as a result of analysis by the main CPU 10, and for example, a page of the words information is written onto the video memory 23. The graphic generator 24 calls appropriate fonts from the external memory device 12 in accordance with the information written onto the video memory 23, and synthesizes analog words/video signal. The video integrator circuit 25 superimposes the words/video signal onto the dynamic image signal from a video reproducing device 21 and the combined picture is presented on a display unit 19. In response to instructions from the main CPU 10 such as page turning, character color turning, words scrolling, switching of dynamic image, and the like, the video integrator circuit 25 causes image presentation to go on according to specified image pattern from among dynamic image data stored in LD 20.

Figure 3:
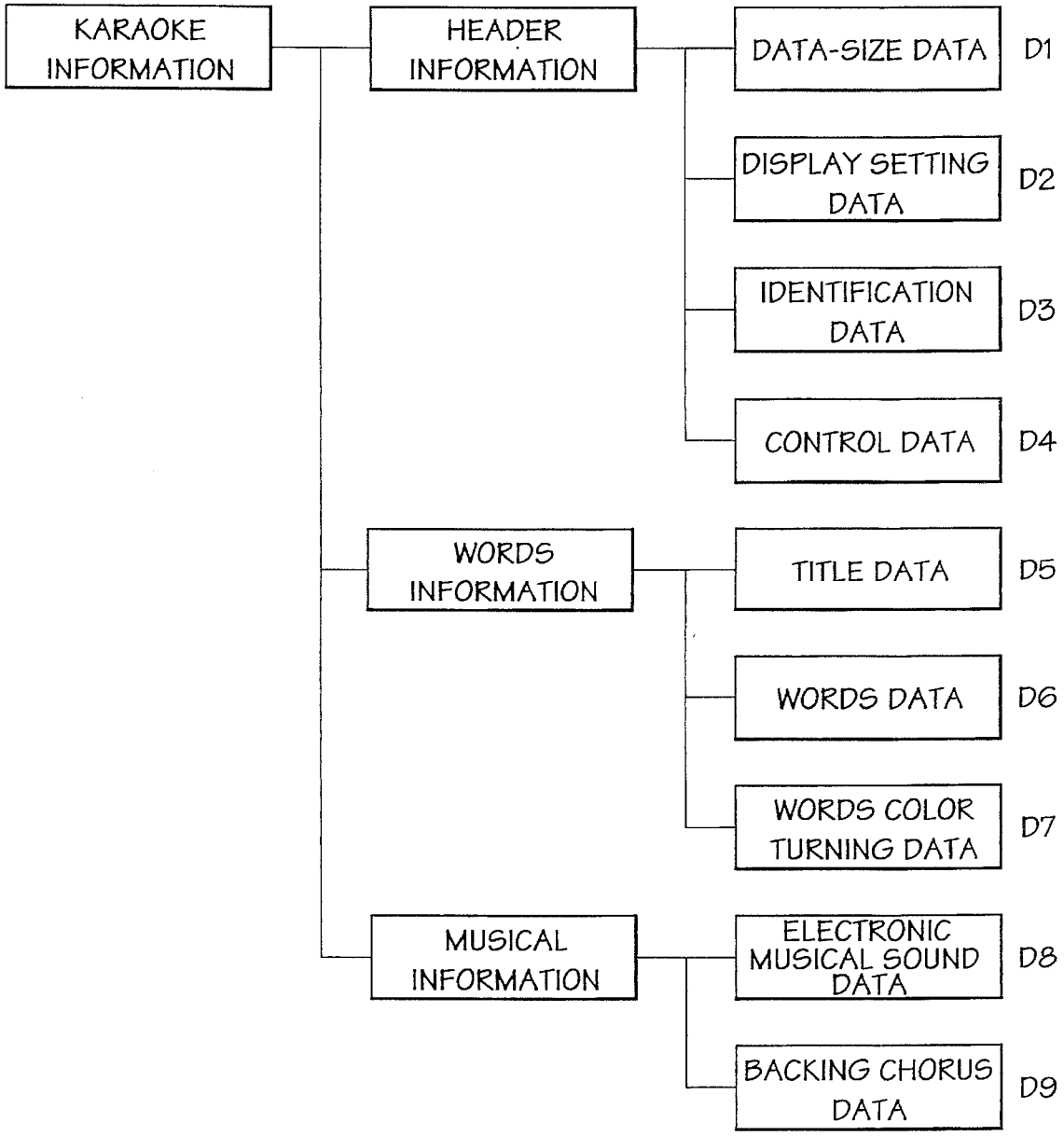
FIG. 3 shows the organization of the karaoke information.

FIG. 3 shows the data structure of the karaoke information according to the present invention. The karaoke information is stored in a plurality of files in a synthesized and compressed form, and is classified in three: the header information, the words information, and the musical information. Referring to FIG. 3, the data structure of each classification is discussed further.

First, the header information comprises data-size data D1 indicative of the amount of information per segmentation unit for each of the words information and the musical information when both are segmented in the order of reproduction, display setting data D2 indicative of font and color setting under which words and the title of a song are presented, identification data D3 that allows retrieval of a music from the corresponding music number and the title of the music, and control data D4 indicative of data processing type and its timing.

The words information comprises title data D5 that identifies the type of the music (single music or medley), participating singers (solo or duet), the color of the title of a song and the location of the title presentation on screen within the song being performed, words data D6 arranged on a per-page basis, and words color turning data D7 indicating color dwell time per dot per word and the number of dots per word to achieve a smoothed color turning. Among these data, the words data D6 are managed on one-page basis, and include setting of color of characters and their outline color on a per-line basis, the number of characters on each line, and the content of words per page.

Figure 4:
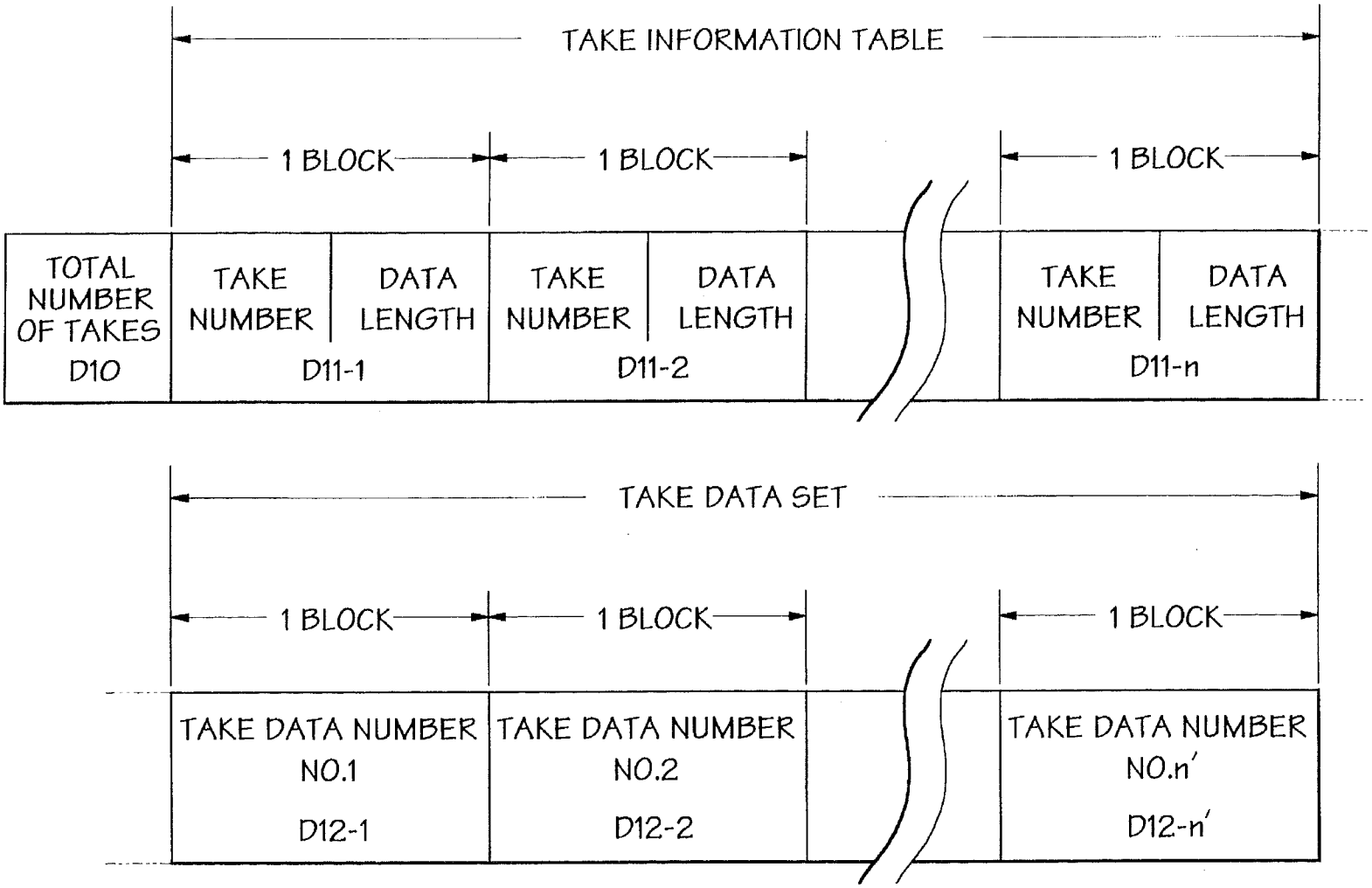
FIG. 4 shows the data structure of the backing chorus data.

The musical information is made up of electronic musical sound data D8 and backing chorus data D9. The electronic musical sound data D8 includes the data length of an entire music and a plurality of electronic musical sound process data segmented by process segment. Each electronic musical segmented data, constructed of time interval data and sound source data, corresponds to a phrase of a score. The backing chorus data D9 and the control data D4 are now detailed further referring to FIG. 4. As seen from FIG. 4, the backing chorus data is constructed of the total number of takes n (D10), take numbers arranged in the order of reproduction in synchronism with the progress of the music but started at an arbitrary number, take information table comprising n blocks D11-1, D11-2, . . . , D11-n, with each block corresponding to the data length of each take number, and a take data set made of a plurality of take data D12 corresponding to the take numbers. The take data set comprises n' blocks of D12-1, D12-2, . . . , D12-n', with each block with the take number corresponding to take number D11 of the take information table. The take numbers are not necessarily arranged in a continued format; by arranging the same number repeatedly, the corresponding take data are specified repeatedly. Thus, the number of total block n' is not necessarily equal to the total number n of the take D10.

Figure 5:
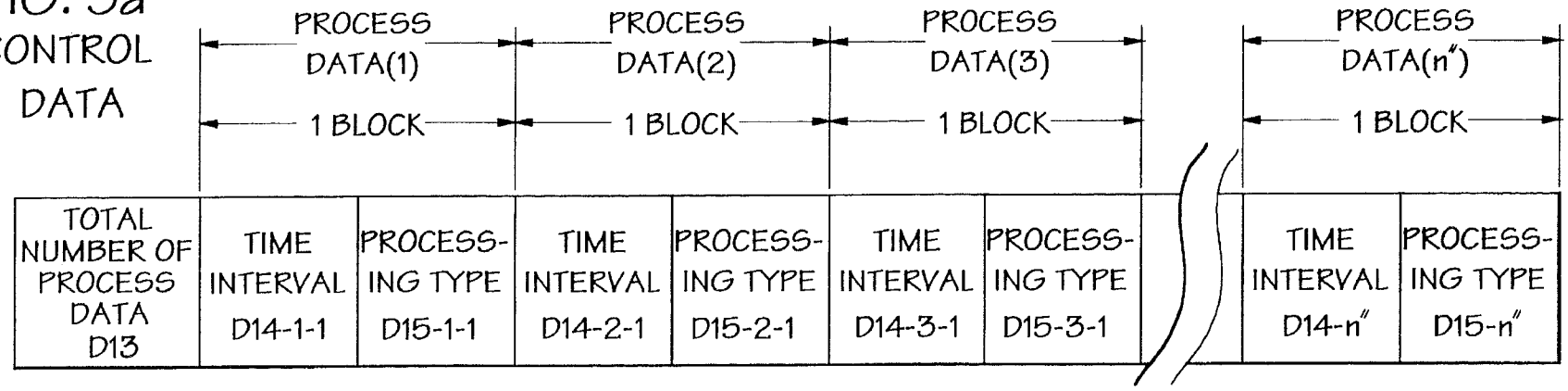
FIG. 5(*a*) and 5(*b*) show the structure of the control data.

FIG. 5(*a*), (*b*) illustrate the data structure of the control data D4 more in detail. The control data D4 is constructed of the indication of the total number of process data in connection with timings that take place in a music and a plurality of blocks segmented and arranged in the order of reproduction. Each block has a pair of a time interval measured according to the tempo of the music and a processing type. The time interval is an interval represented in the number of counts between the current processing timing and a subsequent processing timing. The internal clock in the CPU 10 may be used as a reference of time, for example, two clock cycles may be counted as one interrupt-count pulse. The processing type data includes a processing identification (ID) that specifies the presentation of the words and the initiation of backing chorus as shown in FIG. 5(*b*). As seen from FIG. 5(*a*), the control data D4 includes n" blocks of data, arranged in series, (D14-1, D15-1), . . . , (D14-n", D15-n") in the order of reproduction along with the progress of the music, wherein each block is process data corresponding to time interval and processing type. The number n" corresponds to the total number of process data D13 contained in the music. The processing type in each block bears each corresponding ID as shown in FIG. 5(*b*). For example, if blocks 1 and 3 have, as the content of the processing type, ID=5 that indicates the initiation of backing chorus in FIG. 5(*a*), the blocks 1 and 3 must be (D14-1-1, D15-1-1) and (D14-3-2, D15-3-2). In this case, the first process data (D14-1-1, D15-1-1) of the control data D4 correspond to the take number D11-1 that is the first block of the take information table in FIG. 4. Also, the third process data (D14-3-2, D15-3-2) of the control data D4 correspond to the take number D11-2 that is the second block of the take information table.

Figure 6:
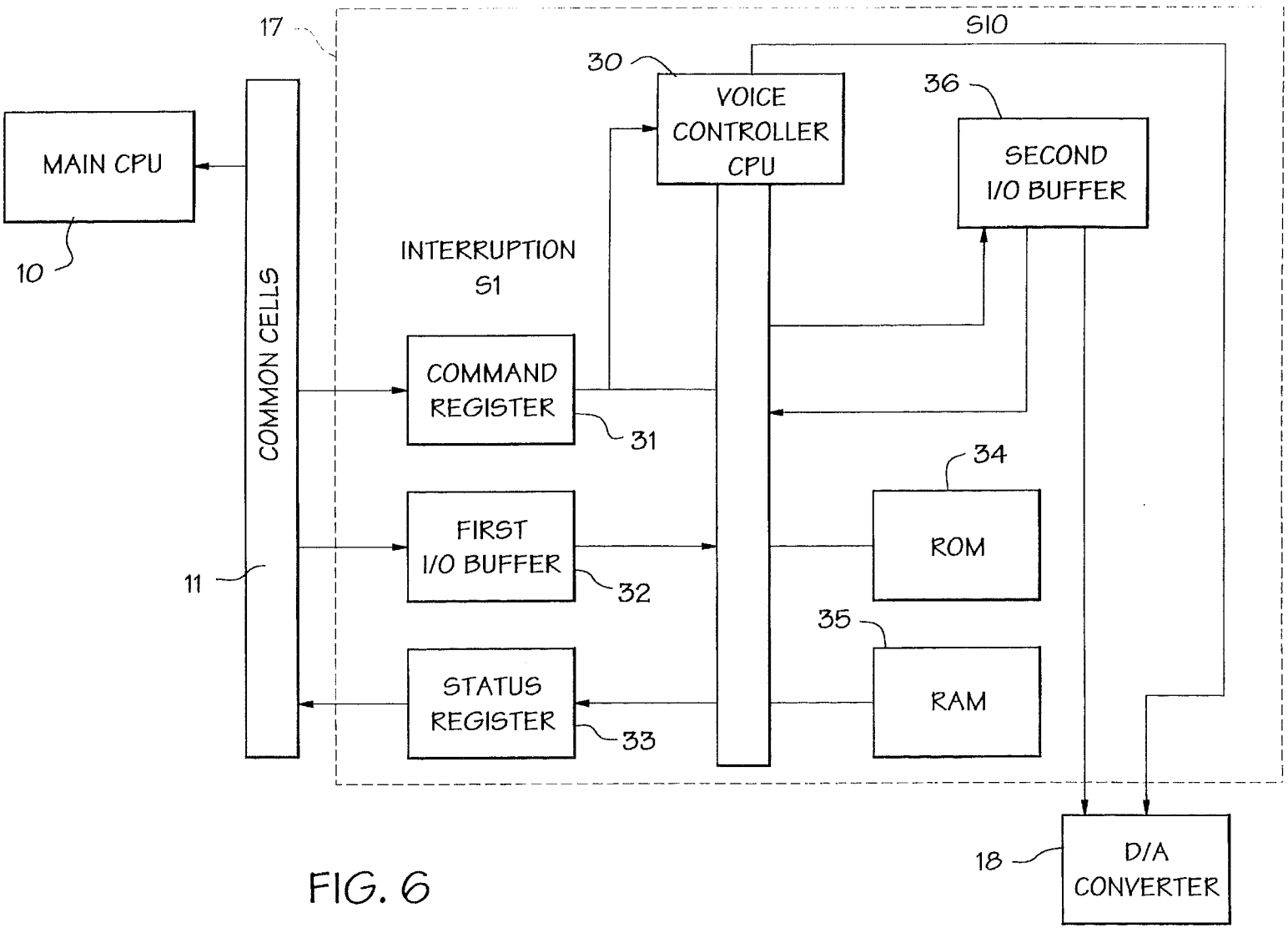
FIG. 6 is a block diagram showing the internal construction of the voice controller.

Referring to the construction of the karaoke machine 4 and the data structure mentioned above, the operation of the backing chorus reproduction operation of the karaoke machine 4 is now discussed. Reference is made to FIG. 6 showing the voice controller 17. In FIG. 6, the main CPU 10 communicates with a voice controller CPU 30 via a command register 31, a status register 33, and a first input/output buffer 32. By setting a command code onto the command register 31, the main CPU 10 initiates an interruption S1 to the voice controller CPU 30, and instructs the voice controller CPU 30 to process. The CPU 10 is notified of the result of process in response to the instruction via the status register 33. Available in addition to the initiation of backing chorus, are the end of chorus, the suspension of chorus, and change of scale.

At power-on or reset, according to the control program stored in a ROM 34, the main CPU 10 downloads the process program of the voice controller 17 to a RAM 35 via the second input/output buffer 36, and then the process program is initiated at the program start instruction issued by the main CPU 10. The process program of the voice controller 17 thus initiated is ready for execution of the processes according to a variety of instructions issued at the backing chorus initiation. When processing the control data D4 shown in FIG. 5(*a*), the main CPU 10 starts counting time intervals against the threshold set at the moment the first electronic musical sound of the music is provided, and performs a process specified by an ID of processing type shown in FIG. 5(*b*) at the moment the interrupt-counts reach the threshold set, i.e., a time-out is reached. In FIG. 5(*a*), for example, the first process data are read. When the content of the processing type D15-1-1 is ID=5 indicating the initiation of backing chorus, the main CPU 10 issues the command code instructing the initiation of backing chorus to the voice controller 17. Before issuing this instruction, the main CPU 10 determines the take number and take data length D11-1, corresponding to the current process, on the first block of the take information table in the backing chorus data D9 in FIG. 4. The main CPU 10 reads the corresponding take data D12-1 from the take data set, and saves the content of the take data D12-1 sequentially starting from its head into the first input/output buffer 32.

If the voice controller CPU 30 receives the command code specifying the initiation of backing chorus via the command register 31 under the above state, the voice controller CPU 30 retrieve the data in the first input/output buffer 32, performs recovery process to the data, for example, decompresses the data according to G722 Standard of CCITT. The original data that were sampled at 16 kHz using the AD-PCM technique are subjected to a sampling rate conversion of 32 kHz, and the resulting data are transmitted at intervals of a few tens of microseconds to the music interval and digital-to-analog converter 18. Since the first input/output buffer 32 is emptied, a subsequent take data is requested to the CPU 10. Thus, a process for each take is repeated.

As described above, the main CPU 10 reads sequentially the blocks of the control data D4, and reproduces backing chorus on a block-by-block basis when ID=5 indicative of the initiation of back chorus. The backing chorus continues until the first input/output buffer 32 is emptied after a chorus end command code is received from the main CPU 10.

When the main CPU 10 receives a scale change command from the operation panel 8 in the middle of performance, the main CPU 10 performs processings separately to the electronic musical sound and backing chorus as follows. Since the electronic musical sound D8 is transmitted to the electronic musical sound source controller 13, the change of scale is also performed by sending a specified scale indicator to the electronic musical sound source controller 13 while assuring word-to-word timing. On the other hand, in the backing chorus processing, the main CPU 10 sends the instruction of scale change along with the scale indicator to the voice controller CPU 30 via the command register 31. Upon receiving the instruction, the voice controller CPU 30 computers the amount of specified transposition and produces a parameter accordingly, and sends it to the tone and digital-to-analog converter 18 via an SIO. Thus, the backing chorus according to the specified key of the scale is reproduced.

As described above, in the karaoke machine according to the present invention, the musical information is decomposed into the electronic musical sound data and the backing chorus data. The electronic musical sound data are based on MIDI Standard, while the backing chorus data are PCM coded human voice data; music performance is enjoyed taking advantage of the features of each data. The header information, the words information and the musical information are integrated into the karaoke information for a music. When the karaoke information is reproduced, control data included in the header information are used to assure synchronization with the timing of the data included in both the words information and the musical information. Thus, no out-of-synchronization takes place in the reproduction and the words information. MIDI-based electronic musical sound data is easy to process allowing creative combination of sound, and further human backing chorus is combined with the electronic musical sound in exact synchronism; thus, a high-quality, sophisticated karaoke machine results.

The backing chorus data are segmented into a plurality of blocks, and repeated use of take data by block minimizes memory capacity requirement for the backing chorus data. This results in reduced karaoke information per a music, leading to a compact karaoke machine with enhanced processing capability. The operation panel is also available to instruct a change of scale as needed, and thus karaoke reproduction is optimized to the voice range of a singer.

What is claimed is:

1. A backing chorus reproducing device for a karaoke machine comprising:

operating means for inputting an instruction for a music number and a change of scale;

memory means for storing karaoke information;

main controller means for analyzing the karaoke information read from the memory means to decompose the information into header information, song's words information, and musical information, while electronic musical sound data and backing chorus data of the musical information are output in synchronism according to processing type of control data included in the header information;

electronic musical sound reproducing means for reproducing the electronic musical sound data provided by the main controller means;

a voice controller for reading the backing chorus data of a take which corresponds to the processing type extracted by the main controller means;

backing chorus reproducing means including the voice controller for reproducing the backing chorus data; and image display means for presenting the words information according to instruction given by the main controller means; wherein the main controller means is capable of receiving a scale indicator specified by the operating means, issuing a change of scale instruction along with the scale indicator to the electronic musical sound reproducing means and the voice controller, and changing the scale of the electronic musical sound data and the backing chorus data to assure synchronism in performance.

2. The backing chorus reproducing device for a karaoke machine according to claim 1 wherein said main controller means transfers to the voice controller repetitively used take data out of the take data to which the backing chorus data are segmented by block.

3. The backing chorus reproducing device for a karaoke machine according to claim 1 further comprising communications control means for receiving via a communications line, a plurality of karaoke information that is stored in a host computer.

4. A backing chorus reproducing device for a karaoke machine comprising:

memory means for storing a plurality of karaoke information each comprising header information, words information and musical information;

operating means for inputting an instruction for a musical number and a change of scale;

main controller means for reading karaoke information from the memory means, for controlling an electronic sound source and reproducing electronic sound in accordance with electronic musical sound data in the karaoke information and for outputting operational commands;

a voice controller for reproducing backing chorus data which comprises voice codes corresponding to the backing chorus data in musical information; and image display means for displaying the words information according to the words information;

wherein the main controller means is capable of analyzing data operating kind and operating timing according to the header information, and outputting commands in predetermined timing for synchronizing the voice controller and the image display means with the reproduced electronic sound.

* * * * *